United States Patent [19]

Steimann

[11] 4,026,769

[45] May 31, 1977

[54] ADJUSTABLE SEALING FRAME FOR COKE-OVEN DOOR

[75] Inventor: Franz Steimann, Gelsenkirchen, Horst, Germany

[73] Assignee: Didier Engineering GmbH, Essen, Germany

[22] Filed: May 29, 1975

[21] Appl. No.: 582,407

[30] Foreign Application Priority Data

June 19, 1974 Germany ..... 2429333

[52] U.S. Cl. ..... 202/248; 202/269

[51] Int. Cl.[2] ..... C10B 25/06; C10B 25/16

[58] Field of Search ..... 202/248, 242, 247, 269; 122/498; 110/173 R; 126/190, 197

[56] References Cited

UNITED STATES PATENTS

| | | | |
|---|---|---|---|
| 1,054,578 | 2/1913 | Madison | 202/247 |
| 2,038,051 | 4/1936 | Lymn | 202/248 |
| 2,744,858 | 5/1956 | Homan | 202/248 |
| 3,933,598 | 1/1976 | Pries | 202/248 |

FOREIGN PATENTS OR APPLICATIONS

| | | | |
|---|---|---|---|
| 918,931 | 8/1954 | Germany | 202/269 |
| 915,564 | 7/1954 | Germany | |
| 693,346 | 6/1940 | Germany | |
| 1,018,390 | 5/1958 | Germany | |

*Primary Examiner*—Morris O. Wolk
*Assistant Examiner*—Bradley Garris
*Attorney, Agent, or Firm*—Wenderoth, Lind & Ponack

[57] ABSTRACT

A sealing frame includes a flexible metallic profiled bar having a bent transverse cross section formed by a longitudinally extending apex joining longitudinally extending arms. Attachment bolts extend through the bar at the apex and are threaded into a coke-oven door element. Tightening of the bolts stretches the bar by increasing the angle of the apex.

7 Claims, 2 Drawing Figures

ADJUSTABLE SEALING FRAME FOR COKE-OVEN DOOR

BACKGROUND OF THE INVENTION

The present invention relates to a coke-oven door including a sealing frame that is arranged on the door element or body. The sealing frame is adjustable perpendicularly to the plane of the door, and can be fixed by means of attachment bolts which are screwed into the door element in a direction parallel with the plane of the door.

Coke-oven doors of this kind are known in a great number of embodiments. The sealing frame may be readjusted in this connection by means of eccentric disks (see German Pat. Nos. 915,564 and 918,931), or by means of wedge-shaped adjustment elements (see German Pat. No. 554,550, German printed specification 1,225,140 and German specification laid open for public inspection 2,214,472). No special adjustment elements are provided in the case of more simple designs (see German Pat. Nos. 926,364 and 928,463).

The sealing frame on such known coke-oven doors can be readjusted only when the attachment bolts are loosened. Therefore, it may happen that the sealing frame is displaced accidentally from the provided setting still prior to or during the re-tightening of the attachment bolts. Besides, the known doors are associated with the disadvantage that the holding arrangement for the sealing frame is held only through the force of friction, i.e., only in a force-locking manner, so that it can be relatively easily loosened through jolts or blows.

SUMMARY OF THE INVENTION

The object of the present invention is to provide a coke-oven door of the type mentioned above, but which is precisely, easily and reliably adjustable, while still having a structurally simple sealing frame.

This object is achieved according to the present invention by providing that the sealing frame consists of a flexible metallic profiled bar that is elastically curved in the longitudinal direction thereof. Attachment bolts extend through the bar in the area of the apex of the curvature thereof. The bar is supported on its lateral edges as well as on the back side thereof against bearing surfaces of the door element. During tightening of the attachment bolts the profiled bar is stretched through a reduction in its curvature.

Accordingly, the door seal of the invention consists only of a flexible metallic profiled element, which need not be a machined element, and a number of standard, commercially available attachment bolts that are screwed directly into the door element that is likewise unfinished. The sealing frame is readjusted in a most simple manner by tightening or loosening the attachment bolts, without loosening in this connection the sealing frame itself. The profiled bar is relatively stretched in this connection, so that its sealing edge projects more or less from the door element. Additionally, the proposed arrangement provides a reliable support and attachment of the sealing frame to the door element.

The bearing surfaces provided for the profiled bar on the door element are expediently rounded. This facilitates the stretching or contraction of the profiled bar during readjustment thereof.

In a further development of the invention, the two longitudinal edges of the profiled bar are also rounded. On the one hand, this produces a constant satisfactory contact of the profiled bar on the door frame, independently of the setting of the sealing frame. On the other hand, the sealing frame can rest effectively with its rear side edge against the door element.

BRIEF DESCRIPTION OF THE DRAWINGS

The invention is described more in detail in the following description by means of an exemplary embodiment and with reference to the attached drawings, wherein.

DETAILED DESCRIPTION OF THE INVENTION

Figure 2:
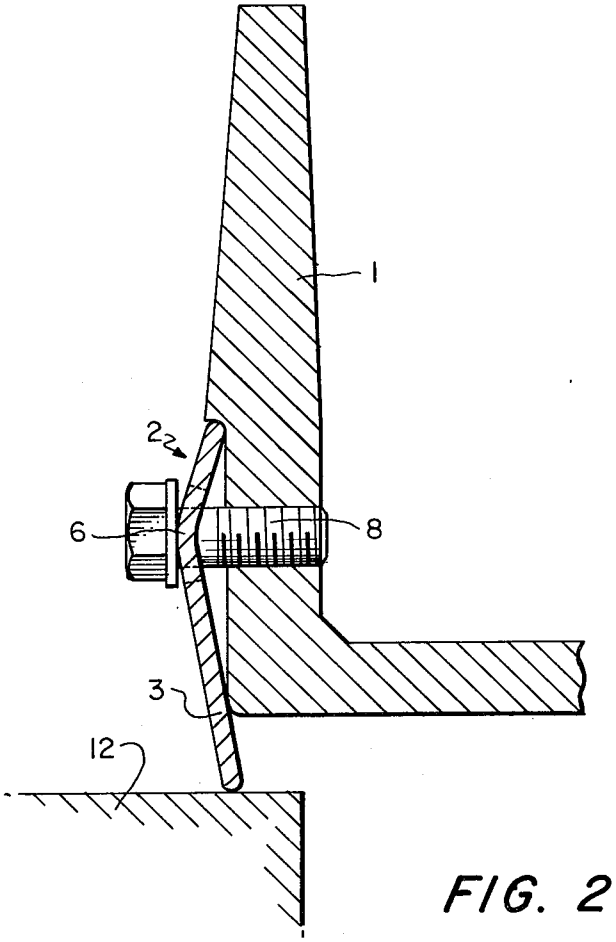
FIG. 2 is a partial section of the coke-oven door of FIG. 1, but with the sealing frame thereof being shown in a further setting.
Figure 1:
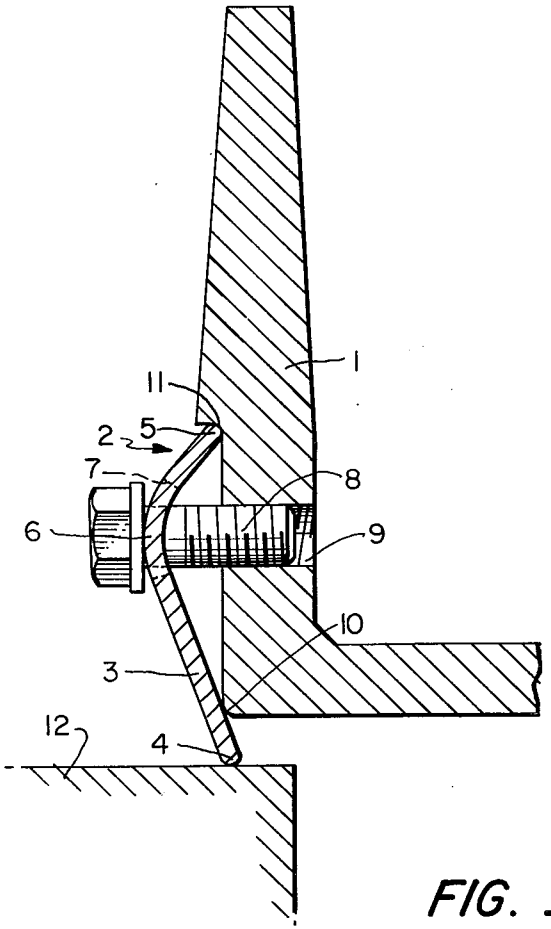
FIG. 1 is a partial section through a coke-oven door including a sealing frame according to the invention.

In FIGS. 1 and 2, the door element or body member of a coke-oven door is designated by the numeral 1. A sealing frame 2, consisting of a flexible metallic profiled bar 3, is arranged around door element 1.

Profiled bar 3 is made of a band of spring steel with rounded longitudinal edges 4 and 5. Bar 3 has a cross sectional configuration formed by arms extending in the longitudinal direction and joined by an apex 6 situated approximately two thirds of the width of the bar from longitudinal edge 4, which is employed as the sealing edge and which is the outermost edge. The angle of the apex is selected such that in the relaxed state of the bar the angle between the two arms of the profiled bar amounts to 120°–135°.

In the area of apex 6, profiled bar 3 is provided with a plurality of bores 7 spaced in the longitudinal direction of the bar, attachment bolts 8 being passed through the bores. Bores 7 may consist of oblong holes whose longitudinal axis is directed transversely to the longitudinal axis of the profiled bar 3.

Attachment bolts 8 are arranged to extend parallel to the plane of the door and are screwed into threaded bores 9 in door element 1. Profiled bar 3 rests at its edge 5, and at a side surface, against respective rounded bearing surfaces 11 and 10 of door element 1. Bar 3 is pressed against bearing surfaces 10 and 11 through the tightening of attachment bolts 8.

Supporting surface 11 consists of a recess and is employed simultaneously as a lateral contact surface for profiled bar 3 and also as an abutment for absorbing the force of reaction which acts on sealing frame 2 when the door is locked.

Sealing frame 2 is relatively positioned as a function of the distance between door element 1 and a door frame 12 when the door is locked. The adjustment or readjustment of frame 2 is effected in a most simple manner by tightening or loosening attachment bolts 8, owing to which profiled bar 3 is stretched or contracted through increase or reduction in the angle of apex 6. This motion is facilitated through the rounded shape of bearing surfaces 10 and 11 as well as of rear longitudinal edge 5 of profiled bar 3. The rounding of sealing edge 4 provides for a constant reliable seal on door frame 12, independently of the specific setting of the sealing frame.

Of course, within the scope of the invention it is also possible to provide a different profile for bar 3, e.g., the shape of a simple pipe clamp. In this connection it matters only that the profiled bar be provided with an elastic curvature between its longitudinal edges, the curvature producing a stretching or contraction of the profiled bar in the manner which is described, i.e., through tightening or loosening of attachment bolts 8.

Other modifications may be made without departing from the scope of the invention.

What is claimed is:

1. A coke oven door sealing assembly comprising a door frame, a door element within said frame, and a sealing means attached to and extending around the periphery of said door element for providing a gas seal between said door element and said frame, said sealing means comprising:

a flexible metallic bar having a bent transverse cross sectional configuration formed by two arms joined at an apex, said apex and edges of said arms extending longitudinally of said bar;

said bar being positioned with the edge of a first of said arms sealingly contacting said frame;

said door element having a first longitudinal bearing surface sealingly contacting the edge of a second of said arms;

said door element having a second longitudinal bearing surface contacting said bar; and a plurality of bolt means, extending through said bar at positions adjacent said apex and adjustably threaded into said door element in directions parallel to the plane thereof, for simultaneously fixing said bar to said door element and for selectively adjusting said bar in a direction perpendicular to said plane of said door element by selectively tightening and loosening said bolts and thereby increasing and reducing the angle of said apex.

2. An assembly as claimed in claim 1, wherein said first bearing surface is formed by a longitudinal recess in said door element.

3. An assembly as claimed in claim 1, wherein said bearing surfaces are rounded.

4. An assembly as claimed in claim 1, wherein said edges are rounded.

5. An assembly as claimed in claim 1, wherein said second bearing surface contacts a side surface of said first arm of said bar.

6. An assembly as claimed in claim 1, wherein said bar is positioned with said apex spaced from said door element.

7. An assembly as claimed in claim 1, further comprising longitudinally spaced bores in said bar adjacent said apex, said bolt means extending through said bores, said bores being oblong and each having a major axis transverse to the longitudinal axis of said bar.

* * * * *